US009913563B2

(12) United States Patent
Schultink et al.

(10) Patent No.: US 9,913,563 B2
(45) Date of Patent: Mar. 13, 2018

(54) RETAINING PLATE

(71) Applicant: Eurofilters N.V., Overpelt (BE)

(72) Inventors: Jan Schultink, Overpelt (BE); Ralf Sauer, Overpelt (BE)

(73) Assignee: Eurofilters N.V., Overpelt (BE)

( * ) Notice: Subject to any disclaimer, the term of this patent is extended or adjusted under 35 U.S.C. 154(b) by 789 days.

(21) Appl. No.: 14/365,816

(22) PCT Filed: Dec. 17, 2012

(86) PCT No.: PCT/EP2012/075785
§ 371 (c)(1),
(2) Date: Jun. 16, 2014

(87) PCT Pub. No.: WO2013/092485
PCT Pub. Date: Jun. 27, 2013

(65) Prior Publication Data

US 2014/0352102 A1 Dec. 4, 2014

(30) Foreign Application Priority Data

Dec. 22, 2011 (EP) ..... 11010202

(51) Int. Cl.
*A47L 9/14* (2006.01)

(52) U.S. Cl.
CPC ..... *A47L 9/1445* (2013.01); *A47L 9/1436* (2013.01)

(58) Field of Classification Search
CPC ..... A47L 9/1445; A47L 9/1436; A47L 9/14
USPC ..... 15/347
See application file for complete search history.

(56) References Cited

U.S. PATENT DOCUMENTS 4,105,386 A * 8/1978 Thiel ..... B29C 47/0021 425/217
2012/0216494 A1* 8/2012 Schultink ..... A47L 9/1445 55/378

FOREIGN PATENT DOCUMENTS

| | | | |
|---|---|---|---|
| DE | 21 16579 | B2 | 10/1972 |
| DE | G 86 22 890.0 | U1 | 2/1988 |
| DE | 296 15 163 | U1 | 1/1997 |
| DE | 201 01 466 | U1 | 5/2001 |
| DE | 201 01 471 | U1 | 5/2001 |
| DE | 10 2008 046 200 | A1 | 4/2009 |
| DE | 10 2007 053 151 | A1 | 5/2009 |
| DE | 20 2008 018 055 | U1 | 6/2011 |
| DE | 20 2011 103 174 | U1 | 12/2011 |
| WO | WO 01/78571 | A1 | 10/2001 |

OTHER PUBLICATIONS

International Preliminary Report on Patentability dated Jul. 3, 2014 for International Application No. PCT/EP2012/075785.

* cited by examiner

*Primary Examiner* — David Redding
(74) *Attorney, Agent, or Firm* — Brinks Gilson & Lione

(57) ABSTRACT

The invention relates to a retaining plate for a vacuum cleaner bag which has an inlet opening, the retaining plate being formed by thermoforming and subsequent stamping of a film made of a thermoplastic material.

19 Claims, 2 Drawing Sheets

RETAINING PLATE

Figure 1:
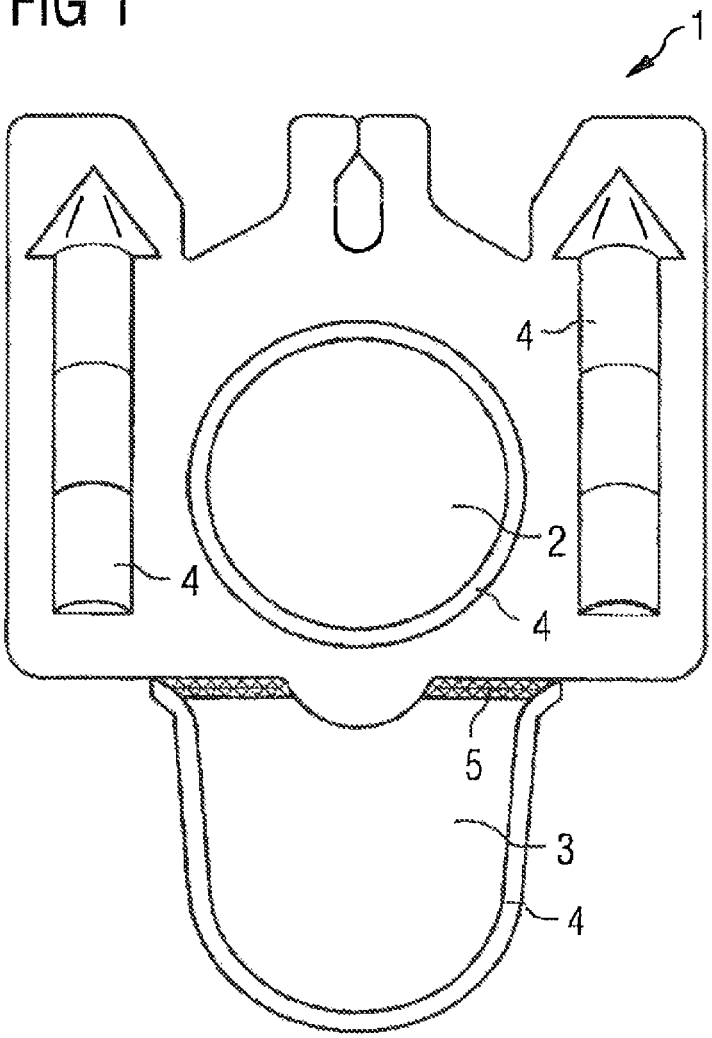

This application claims the benefit under 35 U.S.C. §371 of International Application No. PCT/EP2012/075785, filed Dec. 17, 2012, which claims the benefit of European Patent Application No. 11010202.7, filed Dec. 22, 2011 which are incorporated by reference herein in their entirety.

The invention relates to a retaining plate for a vacuum cleaner bag which has an inlet opening, the retaining plate being formed by thermoforming and subsequent stamping of a film made of a thermoplastic material.

Retaining plates for vacuum cleaner filter bags are known in the state of the art and are produced from cardboard or plastic material.

Cardboard retaining plates are stamped from sheets of cardboard. Possibly, rubber seals are glued thereon. Thicker and stronger cardboard retaining plates are produced by laying, one upon the other, or folding, one upon the other, and glueing multiple layers of cardboard. A rubber seal can thereby be fixed also between two layers of cardboard. Equipping with a manual or automatic seal is also common, with which it is possible to close the filter bag before removal from the vacuum cleaner. Solutions with slides are known, e.g. EP 1 284 629 B1, and flaps, e.g. DE 296 15 163 U1. Retaining plates made of cardboard can be produced economically also on a small scale since the tooling costs for the stamping tools are low. A basic problem however is attaching the cardboard retaining plate on the filter bag, in particular on filter bags made of nonwoven materials. Glueing to the filter bag does not lead to the desired high tear-off forces since the cardboard is inclined to delaminate and the adhesive connection can hence not be stronger than the force leading to delamination. DE 102 03 434 A1 describes welding a cardboard retaining plate to a filter bag made of a nonwoven material when the cardboard retaining plate is coated laboriously with plastic material.

Plastic material retaining plates are produced in the injection moulding method, as described in DE 201 01 471. This allows complex shapes and integration of seals by 2K injection moulding methods. P 21 16579.7-15 and G 86 22 890.0 disclose one-piece plastic material retaining plates with sealing lips moulded thereon. Joining to the nonwoven filter bags which are common today is generally effected by ultrasonic welding methods. Glueing to the filter bag by means of a hot-melt adhesive is also common. In addition to the moulded-on elastomer seals, also sealing elements in which the filter bag material acts as sealing element or in which a film or a sealing membrane is glued on the retaining plate or is positioned between retaining plate and filter bag or is situated in the interior of the filter bag are common. A plastic material retaining plate having a closure flap to be activated manually is disclosed in DE 10 2007 053 151 A1. Plastic material retaining plates which close fully automatically are disclosed in DE 10 2008 046 200 A1 and also in DE 20 2008 018 055 U1.

As shown above, the retaining plates made of cardboard which are actually to be produced at low cost hence have the disadvantage that these cannot be joined to plastic material nonwoven bags without problems and, on the other hand, production of plastic material retaining plates in the injection moulding method is very complex because a corresponding tool which is very expensive must be produced respectively for this purpose.

Starting herefrom, it is therefore the object of the present invention to propose a retaining plate which, on the one hand, is producible economically with simple tools and which, on the other hand, can be joined to filter bags made of nonwoven material without difficulty.

This object is achieved by the features of patent claim 1. The sub-claims reveal advantageous developments.

According to the invention, a retaining plate for a vacuum cleaner bag which is formed preferably from a nonwoven material is hence proposed, which retaining plate is formed by thermoforming and subsequent stamping of a film made of a thermoplastic material.

As a result of the fact that, according to the invention, the retaining plate is produced by thermoforming (deep-drawing) and stamping, economical retaining plates which are made of a thermoplastic material are made available and can be joined without difficulty to the thermoplastic nonwoven material of a vacuum cleaner filter bag. The production process of thermoforming (deep-drawing) is fast and economical. The tooling costs are low and hence allow a more favourable production on a small scale. Thermoforming is a method for forming thermoplastic materials. According to the invention, the thermoforming is implemented with a film. The process of thermoforming and the tools required for this purpose are known to the person skilled in the art. Common methods hereby are so-called vacuum forming and compressed air forming. The advantage of vacuum forming resides in both the machines and the tools being inexpensive. In the case of vacuum forming, a so-called negative forming can thereby be implemented, in which generally a stamp is used. Positive forming which is likewise possible is generally used only for flat or relief-like parts. Basically, also compressed air forming is possible. Vacuum forming is however favoured according to the present invention since the machines for compressed air forming are expensive and high complexity is required for the tools.

A further advantage of the retaining plate according to the invention which is obtained according to a thermoforming as described above resides in the fact that the thermoplastic material of the retaining plate can be chosen freely so that also a problem-free joining for example by ultrasonic welding to the thermoplastic material of a nonwoven material filter bag is possible. It must be stressed here that the material use is low and the required stability can be controlled via the film thickness and e.g. introduced reinforcing ribs. Furthermore, the new retaining plate is distinguished by the films which are used for the thermoforming normally having high anisotropy so that this can be specifically utilised such that the direction of flexural rigidity extends in the direction of the retaining plate which cannot be reinforced by ribs or beads or which is loaded to a greater degree. A crucial advantage of the retaining plate according to the invention hence resides in the fact that the retaining plates can be produced not only simply and economically but that the properties can be adjusted specifically using the anisotropy of the films and the introduction of ribs or beads. It must be further stressed that the retaining plate according to the invention can also be constructed from multilayer films and the films being able to differ then in the choice of thermoplastic material so that the outward-directed side can consist of a different thermoplastic material from that side which is joined to the nonwoven material.

In addition to transparent or coloured films, also foamed films can be used. As a result, the use of material can be still further reduced. Fibre-reinforced films which can likewise be used during thermoforming and which are preferred in the invention have, with respect to mechanical loadability, even higher anisotropy than non-reinforced films. Also hence the material use can be further reduced or the strength of the plates can be improved. The films can likewise be provided with film hinges during shaping.

The retaining plate according to the invention is thereby preferably configured as a one-piece component. The thermoforming process which is used for the retaining plate according to the invention makes it possible in addition for the retaining plate and the flap to be configured together as a one-piece component, it even being able to be provided also in a preferred embodiment that the flap is joined to the retaining plate in one-piece via a hinge.

From the point of view of materials, it is preferred if the thermoplastic material of the film is selected from polypropylene (PP), polyethylene (PE), polyvinylchloride (PVC), polycarbonate (PC) and/or polyethylene terephthalate (PET). The above-mentioned selection relates only to preferred embodiments. In general, the retaining plates can consist of all of the thermoplastic materials known to the person skilled in the art.

The film which is used during thermoforming can thereby also be a multilayer film with a thickness in the range of 0.2 to 2.5 mm, preferably with a thickness of 0.5 to 1.5 mm. Of course, the invention also includes embodiments in which only a single film in the above-mentioned thickness range is used. It is thereby preferred if, in the case of multilayer films, this is formed from two to twenty layers. Such multilayer films, i.e. laminates, which are then supplied to the thermoforming process, are likewise known and standard in the state of the art. In the case of the retaining plate according to the invention, as a result of the fact that also multilayer films can be used during the thermoforming process, these are configured such that for example that layer, of the laminate foil, which is orientated in the direction of the nonwoven material bag consists of a thermoplastic material with a lower melting point than the external layer. As a result, simple welding is possible. The use of multilayer laminate foils also allows the possibility that one or more of the films is reinforced. Likewise, colour effects and/or ribs and reinforcements can be introduced specifically into the films.

The invention is explained subsequently in more detail with reference to two Figures.

Figure 2:
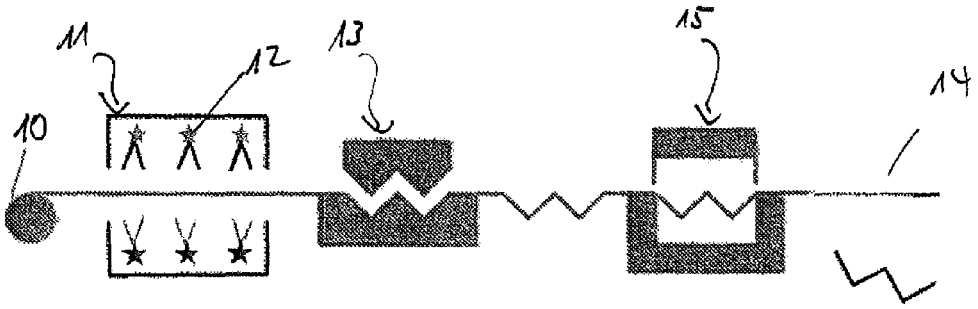

FIG. 1 shows a plan view of a retaining plate according to the invention and FIG. 2, schematically, the course of the process during thermoforming.

The retaining plate 1 illustrated in FIG. 1 has an inlet opening 2 which can be closed with a flap 3. The embodiment shown in FIG. 1 is configured as a one-piece component, i.e. the retaining plate 1 was formed by thermoforming and stamping from a film. The retaining plate 1, as described in FIG. 1, has furthermore reinforcing ribs 4. The reinforcing ribs 4 can be configured in various ways. Preferably, they are configured, like the reinforcing rib 4, in arrow form in a high-deep structure. The reinforcing rib 4 can also be replaced by reinforcing fibres which are present in the film or are present in combination with the reinforcing ribs. The flap 3 is thereby joined to the retaining plate 1 in one-piece via a hinge 5. As a result of the fact that the flap 3 can be joined to the retaining plate 1 via a film hinge 5, an economical production of retaining plates is possible because the flap 3 need not be joined to the remaining component of the retaining plate 1 in a separate procedure but rather can be configured in one-piece. As material for the retaining plate 1, as illustrated in FIG. 1, any materials which can be formed thermoplastically can be used. The selection of the thermoplastic material is thereby directed according to the purpose of use. Thus it can be advantageous to form the retaining plate 1 from two layers of different plastic materials which are disposed one above the other. In this case the layer, orientated towards the filter bag, is formed from a thermoplastic material with a lower melting point than the side orientated away from the filter bag so that the welding process for joining the retaining plate 1 to the filter bag can be effected rapidly and in an energy-saving manner.

In FIG. 2, a unit for thermoforming with roll material which is known from the state of the art is shown in a schematic illustration. As emerges from FIG. 2, the film material from a roll 10 is guided into a heating station 11 which has heat radiators 12. In the heating station 11, heating radiators 12 can thereby be present on one or both sides. In the tool station 13, the film is then retained by means of a tensioning frame, pre-stretchers and the thermoforming tool pass through the film plane and specify the finished contour very roughly. Subsequently, compressed air is then produced from the one side and vacuum from the other side in order to bring the film quickly and firmly against the cooled wall (contour) of the moulding tool 15. The cooled and now solid film is separated from the moulding tool 15 and supplied to the stamping station 14 in the next operating step.

The operating course described, as above in the case of FIG. 2, is also applied for the retaining plate illustrated in FIG. 1.

The invention claimed is:

1. A retaining plate for a vacuum cleaner bag which has an inlet opening which can be closed with a flap, the retaining plate comprising:

a film made of a thermoplastic material, wherein the retaining plate is formed by thermoforming and subsequent stamping of the film.

2. The retaining plate according to claim 1, wherein the retaining plate comprises a one-piece component.

3. The retaining plate according to claim 2, wherein the retaining plate and the flap comprise a one-piece component.

4. The retaining plate according to claim 3, wherein the flap is joined to the retaining plate in one-piece via a hinge.

5. The retaining plate according to claim 1, wherein the film is a single or multilayer film (laminate) with a thickness in the range of 0.2 to 2.5 mm.

6. The retaining plate according to claim 5, wherein the multilayer film is formed from two to twenty layers.

7. The retaining plate according to claim 6, wherein the thermoplastic material of at least one layer is different from the thermoplastic material of at least one other layer.

8. The retaining plate according to claim 1, wherein the film has an anisotropic morphology.

9. The retaining plate according to claim 1, wherein the film is reinforced.

10. The retaining plate according to claim 9, wherein the retaining plate has reinforcing ribs or beads.

11. The retaining plate according to claim 1, wherein the thermoplastic material is selected from polypropylene (PP), polyethylene (PE), polyvinylchloride (PVC), polycarbonate (PC) or polyethylene terephthalate (PET).

12. The retaining plate according to claim 5 wherein the film has a thickness in the range of 0.5 to 1.5 mm.

13. The retaining plate according to claim 5, wherein the multilayer film is reinforced.

14. A vacuum cleaner bag comprising:

a bag comprising a nonwoven material; and a retaining plate for the vacuum cleaner bag having an inlet opening which can be closed with a flap, the retaining plate comprising:

a film made of a thermoplastic material, wherein the retaining plate is formed by thermoforming and subsequent stamping of the film.

15. A method of manufacturing a retaining plate for a vacuum cleaner bag having an inlet opening that is closable with a flap, the method comprising:

thermoforming the retaining plate from a film made of a thermoplastic material; and stamping the thermoformed retaining plate.

16. The method according to claim 15, comprising joining the retaining plate to the flap via a hinge in a one-piece configuration.

17. The method according to claim 15, comprising manufacturing the retaining plate as a one-piece component.

18. The method according to claim 15, comprising reinforcing the film.

19. The method according to claim 15, comprising joining the retaining plate to the flap of the vacuum cleaner bag comprising a nonwoven material.

* * * * *